US005112275A

United States Patent [19]

Sato

[11] Patent Number: 5,112,275

[45] Date of Patent: May 12, 1992

[54] COIN SEPARATOR WITH MEANS FOR DETECTING AN ERRONEOUSLY SEPARATED COIN

[75] Inventor: Naoto Sato, Maebashi, Japan

[73] Assignee: Sanden Corporation, Gunma, Japan

[21] Appl. No.: 552,844

[22] Filed: Jul. 11, 1990

Related U.S. Application Data

[63] Continuation of Ser. No. 251,848, Oct. 3, 1988, abandoned.

[30] Foreign Application Priority Data

Oct. 1, 1987 [JP] Japan ..... 62-149226[U]
Oct. 2, 1987 [JP] Japan ..... 62-150560[U]
Oct. 7, 1987 [JP] Japan ..... 62-152681[U]

[51] Int. Cl.[5] ..... G07D 3/02

[52] U.S. Cl. ..... 453/5; 194/338; 453/17

[58] Field of Search ..... 194/317, 318, 319, 334, 194/338; 453/3, 5, 9, 15, 17, 8

[56] References Cited

U.S. PATENT DOCUMENTS 1,327,357 1/1920 Rogers ..... 453/8
1,421,992 7/1922 Roeling et al. ..... 453/9
3,906,965 9/1975 Luyben et al. ..... 453/9
4,040,434 8/1977 Watanabe et al. ..... 453/17
4,220,234 9/1980 Sheltra ..... 453/3 X
4,234,072 11/1980 Prumm ..... 194/317
4,286,703 9/1981 Schuller et al. ..... 194/317
4,625,851 12/1986 Johnson et al. ..... 194/200

FOREIGN PATENT DOCUMENTS 52-043497 5/1977 Japan .
59-40968 3/1984 Japan .
60-044162 3/1985 Japan .
61-237190 10/1986 Japan .

*Primary Examiner*—F. J. Bartuska
*Attorney, Agent, or Firm*—Banner, Birch, McKie & Beckett

[57] ABSTRACT

For reducing trouble in a coin selecting part coupled to a plurality of coin paths (21, 22, 23, 24), a coin separator comprises a discharge arrangement for discharging an erroneous coin from a particular one (21) of the coin paths to another coin path (42). As a result, the erroneous coin does not remain in the particular coin path. Therefore, the coin selecting part is protected from the trouble thereof even if the erroneous coin is supplied to the particular coin path. The coin separator may be constituted so that the particular coin path is closed by the selecting part after the erroneous coin is detected in a storing part (46) which is coupled to the particular coin path.

63 Claims, 5 Drawing Sheets

| COIN KIND | UNACCEPT-ABLE COIN | COIN OF 1st KIND | COIN OF 2nd KIND | COIN OF 3rd KIND | COIN OF 4th KIND | OVERFLOW COIN |
|---|---|---|---|---|---|---|
| 1st GATE | CLOSE | OPEN | OPEN | OPEN | OPEN | OPEN |
| 2nd GATE | CLOSE | CLOSE | OPEN | CLOSE | OPEN | OPEN |
| 3rd GATE | CLOSE | OPEN | OPEN | CLOSE | CLOSE | CLOSE |
| 4th GATE | CLOSE | CLOSE | CLOSE | CLOSE | OPEN | CLOSE |
| DELIVERED POSITION | OUTLET PORTION | 1st TUBE | 2nd TUBE | 3rd TUBE | 4th TUBE | CASH BOX |

COIN SEPARATOR WITH MEANS FOR DETECTING AN ERRONEOUSLY SEPARATED COIN

This application is a continuation of application Ser. No. 07/251,848, filed Oct. 3, 1988 now abandoned.

BACKGROUND OF THE INVENTION

This invention relates to a coin separator which is for use in a vending machine or the like.

Such a coin separator is for carrying out separation of an intermittent succession of coins and comprises a coin selecting part, a plurality of coin paths, and a plurality of coin storage parts. Each of the coin paths is coupled between the coin selecting part and each of the storage parts. The coin selecting part is for selecting a particular coin from the coins with reference to a kind of each coin and is disclosed in U.S. Pat. No. 4,625,851 issued to Peter R. Johnson et al and assigned to Mars, Inc., McLean, Va. Generally, the particular coin has a predetermined diameter which is different from a diameter of another coin.

The particular coin is delivered to a particular one of the storage parts through a particular one of the coin paths. In order to contain the particular coin, the particular storage part has a diameter slightly larger than the predetermined diameter. The other coin is delivered through another one of the coin paths to another storage part and others.

It will be assumed that the other coin is supplied to the particular coin path in case where the other coin is erroneously selected as the particular coin in the selecting part. In this event, the other coin is also sent towards the particular storage part through the particular coin path.

However, the other coin may not be correctly received in the particular storage part. In case where the diameter of the other coin is larger than the diameter of the particular storage part, the other coin is stopped as an erroneous coin at an inlet end of the particular storage part without being stored therein. As a result, trouble is caused in the coin separator as will presently be described.

When being successively supplied thereafter with the coins to the particular coin path, the coins are superposed with one another on the erroneous coin. This means the coins are arranged along the particular coin path to be adjacent to one another. In other words, arrangement of the coins is expanded one by one in the particular coin path in dependence on supply of the coins. When the particular coin path is filled by the coins, the trouble is caused in the coin separator. This is because operation of the coin selecting part is obstructed by at least one of the coins.

SUMMARY OF THE INVENTION

It is therefore an object of the present invention to provide a coin separator which is capable of reduction of trouble in a coin selecting part.

It is another object of this invention to provide a coin separator of the type described, in which a coin path is not filled by coins even if an erroneous coin is supplied to the coin path.

Other object of this invention will become clear as the description proceeds.

In an aspect of this invention, a coin separator comprises coin selecting means for selecting a particular coin from coins with reference to a kind of each coin, coin storage means for storing the particular coin, a particular coin path with a coin outlet port coupled to the coin selecting means for delivering the particular coin to the coin storage means, and a coupling section for coupling the coin outlet port of the particular coin path and the coin storage means to each other. It will be assumed that the coin selecting means erroneously selects a specific one of coins to supply the specific coin as the particular coin into the particular coin path. The specific coin is different in a coin diameter from the particular coin. According to this invention, the coupling section comprises detecting means for detecting the first coin as an erroneous coin with reference to the coin diameter, and discharging means for discharging the erroneous coin out of the coin storage means from the coupling section.

In another aspect of this invention, a coin separator comprises coin selecting means for selecting a particular coin from coins with reference to a kind of each coin, coin storage means for storing the particular coin, and a particular coin path coupled to the coin selecting means for delivering the particular coin to the coin storage means. The coin storage means has a coupling section coupled to the particular coin path. It will be assumed that the coin selecting means erroneously selects a specific one of the coins to supply the specific coin as the particular coin into the particular coin path. The specific coin is different in a coin diameter from the particular coin. According to this invention, the coin separator further comprises detecting means mounted on the coupling section for detecting the specific coin delivered into the coin storage means from the particular coin path to produce a detection signal, and control means coupled to the detection means and responsive to the detection signal for controlling the selecting means to close the particular coin path.

DESCRIPTION OF THE PREFERRED EMBODIMENTS

Figure 1:
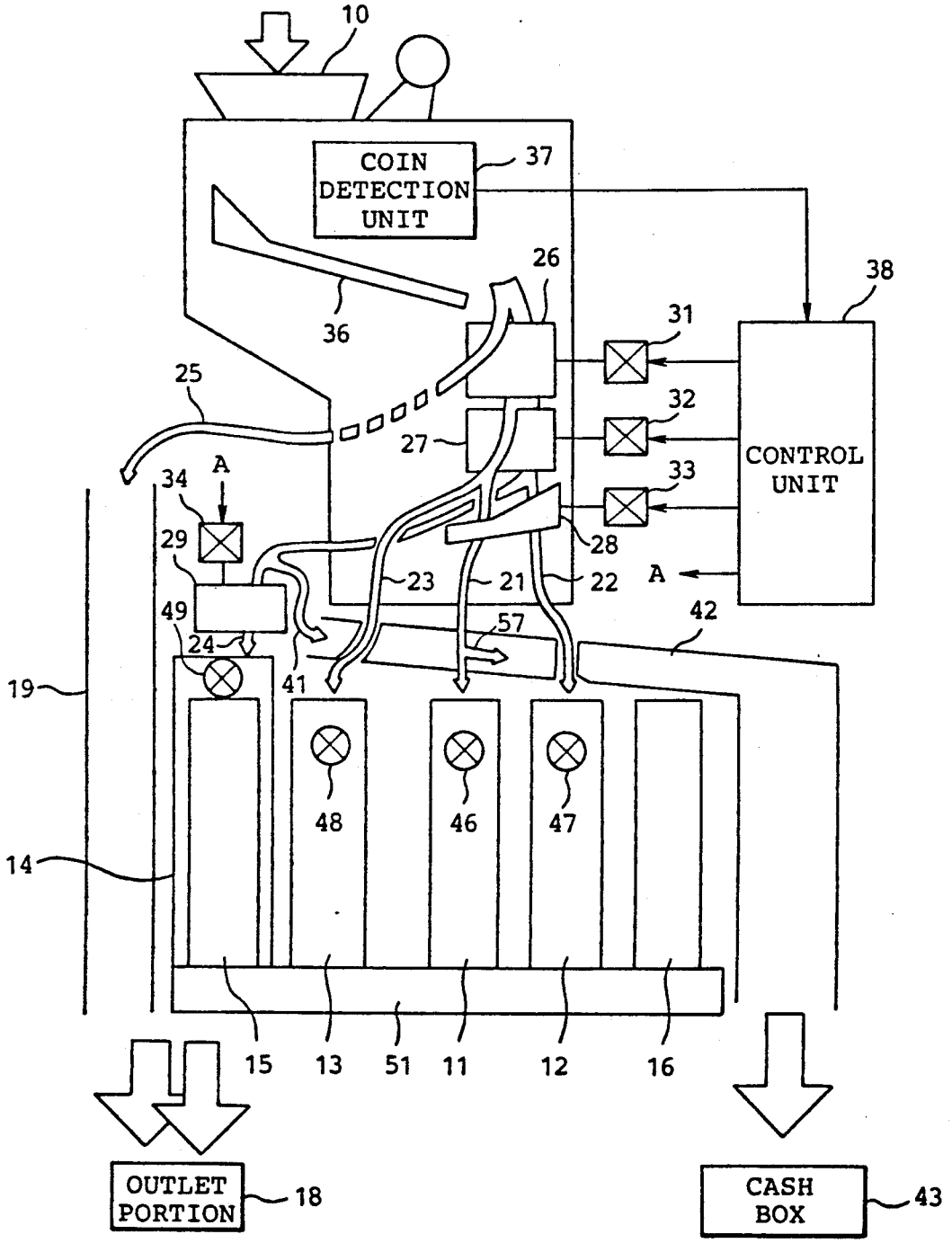
FIG. 1 is a schematic diagram of a coin separator according to a first embodiment of this invention.

Referring to FIG. 1, description will be made as regards a coin separator according to a first embodiment of this invention. The coin separator is for use in a vending machine and is for carrying out separation of coins which are supplied through an inlet portion 10. The coins may be classified into a plurality of, for example, a first through a fifth kind.

Figures 2, 3:
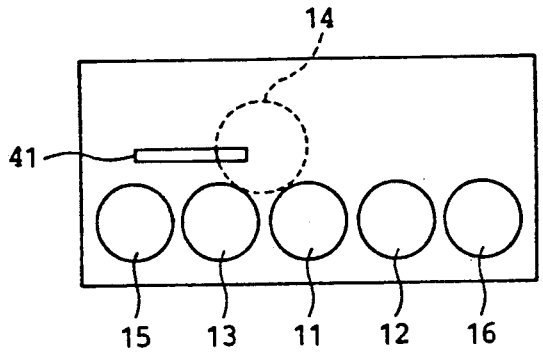
FIG. 2 is a plan view of coin storage parts included in the coin separator illustrated in FIG. 1.
FIG. 3 is a chart for use in describing operation of a coin selecting part included in the coin separator illustrated in FIG. 1.

The coin separator comprises first through sixth coin storage tubes 11, 12, 13, 14, 15 and 16 adjacent to one another as will be clear from FIG. 2. The first through the fourth coin storage tubes 11 to 14 are for storing the coins of the first through the fourth kinds, for example, 50 yen coin, 100 yen coin, 10 yen coin and 500 yen coin in Japanese coins, respectively. Each of the fifth and the sixth coin storage tubes 15 and 16 serves as a sub tube to assist the first and the fourth coin storage tubes 11 to 14. Only each coin of the fifth kind is rejected as an unacceptable or unauthentic coin and is sent to an outlet portion 18 through a reject path 19.

Each coin of the first kind has a first predetermined diameter which is smallest. Each coin of the second kind has a second predetermined diameter which is larger than the first predetermined diameter. Each coin of the third kind has a third predetermined diameter which is larger than the second predetermined diameter. Each coin of the fourth kind has a fourth predetermined diameter which is larger than the third predetermined diameter.

The coin separator further comprises first through fifth coin paths 21, 22, 23, 24, and 25. The first through the fifth coin paths 21 to 25 are controlled by first through fourth gates 26, 27, 28, and 29 as will later be described in detail. The first through the fourth gates 26 to 29 are operated by first through fourth driving elements 31, 32, 33, and 34. Each of the first through the fourth driving elements 31 to 34 is, for example, an electromagnetic solenoid. A combination of the first through the fourth coin gates 26 to 29 will be called a gate part. The first through the fourth driving elements 31 to 34 are collectively called a driving part.

Each of the first through the fifth coin paths 21 to 25 is extended upwardly and downwardly and has an upper and a lower end. The lower ends of the first through the fourth coin paths 21 to 24 are coupled to the first and the fourth coin storage tubes 11 to 14, respectively. The lower end of the fifth coin path 25 is coupled to the outlet portion 18 through the reject path 19.

The upper ends of the first through the fifth coin paths 21 to 25 are collectively coupled to the gate part. A coin chute 36 is for guiding the coins supplied through the inlet port 10 to the gate part. In the manner known in the art, a coin detection unit 37 is combined to the coin chute 36 and is for detecting a kind of each coin on the chute 36 to produce a coin signal representative of the kind of each coin.

The coin separator further comprises a control unit 38 electrically coupled to the driving part and the coin detection unit 37. Responsive to the coin signal, the control unit 38 controls the driving part (31-34) to operate the gate part (26-29) in the manner known in the art. In the figure, a control line from the control unit 38 to the fourth driving element 34 is partially omitted for the purpose of simplification of the drawing but is completed by connecting portions shown at A and A in the figure. A combination of the gate part, the driving part, the coin detection unit 37, and the control unit 38 carries out selection of the coins with reference to the kind of each coin and may therefore be referred to herein as a selecting arrangement.

Referring to FIG. 3 together with FIG. 1, description will be made about operation of each of the first through the fourth gates 26 to 29. The coin detection unit 37 detects a current one of the coins which is currently running on the coin chute 36. When the current coin is judged as the unacceptable coin, the control unit 38 controls the driving part so that the first through the fourth gates 26 to 29 are closed. As a result, the current coin is sent to the outlet portion 18 through the fifth coin and the reject paths 21 and 19.

When the current coin is judged as the coin of the first kind, the control unit 38 controls the driving part so that the first and the third gates 26 and 28 are opened and that the second and the fourth gates 27 and 29 are closed. As a result, the current coin is sent to the first coin storage tube 11 through the first coin path 21.

When the current coin is judged as the coin of the second kind, the control unit 38 controls the driving part so that the first, the second, and the third gates 26, 27, and 28 are opened and that the fourth gate 29 is closed. As a result, the current coin is sent to the second coin storage tube 12 through the second coin path 22.

When the current coin is judged as the coin of the third kind, the control unit 38 controls the driving part so that the first gate 26 is opened and that the second, the third, and the fourth gates 27, 28, and 29 are closed. As a result, the current coin is sent to the third coin storage tube 13 through the third coin path 23.

When the current coin is judged as the coin of the fourth kind, the control unit 38 controls the driving part so that the first, the second, and the fourth gates 26, 27, and 29 are opened and that the third gate 29 is closed. As a result, the current coin is sent to the fourth coin storage tube 14 through the fourth coin path 24.

In a case where a selected one of the first through the fourth coin storage tubes 11 to 14 is filled by coins, the control unit 38 controls the driving part so that the first and the second gates 26 and 27 are opened and that the third and the fourth gates 29 are closed. As a result, the current coin is sent as an overflow coin to a branched coin path 41 which branches at the fourth gate 29. The branched coin path 41 is connected to an additional coin path 42 which is connected to a cash box 43. Therefore, the overflow coin is sent from the branched coin path 41 to the cash box 43.

For detecting an amount of the coins, the first through the fourth coin storage tubes 11 to 14 have first through fourth coin overflow sensors 46, 47, 48, and 49 which are electrically coupled to the control unit 38. When each of the first through the fourth coin storage tubes 11 to 14 is stored with a predetermined number of the coins, each of the first through the fourth coin overflow sensors 46 to 49 produces an overflow signal. Responsive to the overflow signal, the control unit 38 controls the driving part as described above.

It is possible to discharge each of the coins as change from the first through the sixth coin storage tubes 11 to 16 to the outlet portion 18 by a change coin delivering unit 51.

Figure 4:
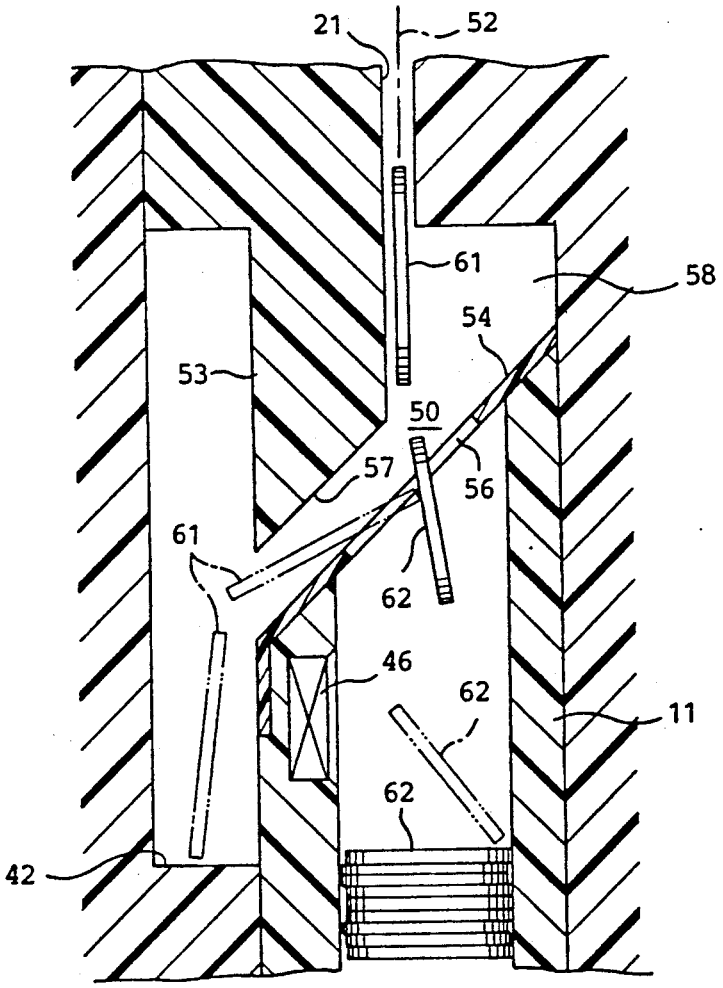
FIG. 4 is a sectional view of a part of the coin separator illustrated in FIG. 1.

Referring to FIG. 4 together with FIG. 1, description will proceed as regards the coin separator. The coin separator further comprises a coupling section 50 for coupling the coin outlet port of the first coin path 21 and the first coin storage tube 11 to each other. The first coin path 21 is extended along a coin path axis 52 which is substantially vertical. The additional coin path 42 is extended in the vicinity of an outlet port, namely, the lower end of the first coin path 21 with a partition wall 53 left therebetween. A plate member 54 is disposed adjacent the outlet port of the first coin path 21 to intersect the coin path axis of the first coin path 21. In addition, the plate member 54 is inclined in connection with the coin path axis and has a cylindrical surface defining a circular opening 56 which is placed on the coin path axis 52. The circular opening 56 has a reference diameter which is larger than the first predetermined diameter but less than the second predetermined diameter.

A discharging coin path 57 is made in the partition wall 53 adjacent to the plate member 54. The discharging coin path 57 has an inlet and an outlet end which are coupled to the first and the additional coin paths 21 and 42, respectively. The first coin path 21 has a recessed portion 58 recessed in an opposite wall which is opposite to the partition wall 53.

For convenience of the description, a wording will be changed hereafter so that the first coin path 21 is called a particular coin path, that each coin of the first kind is called a particular coin, that each coin of the second kind is called a specific coin, that the first predetermined diameter is called a particular diameter, and that the second predetermined diameter is called a specific diameter.

It will be assumed that the particular coin path 21 is supplied with the specific coin 61 in addition to the particular coin 62 in case where the specific coin 61 is erroneously selected in the selecting arrangement. In this event, the particular coin 62 passes through the circular opening 56 and is stored in the first storage tube 11. In other words, the particular coin 62 is discharged from the particular coin path 21. On the other hand, the specific coin 61 is received as an erroneous coin on an upper surface of the plate member 54 without passing through the circular opening 56. This is because the reference diameter of the circular opening 56 is smaller than the specific diameter, namely, the second predetermined diameter of the specific coin 61. The plate member 54 is referred to as a detecting arrangement.

In addition, the specific coin 61 is turned and smoothly slides along the upper surface of the plate member 54 downwardly. The recessed portion 58 serves to facilitate turning of the specific coin 61. As a result, the specific coin 61 is separated from the particular coin 62. Subsequently, the specific coin 61 is discharged from the first coin path 21 to the additional coin path 42 through the discharging coin path 57. It is a matter of course that the specific coin 61 is sent to the cash box 43 through the additional coin path 42. A combination of the discharging coin path 57 and the upper surface of the plate member 54 is referred to as a discharging arrangement.

With the arrangement, the trouble is not caused in the gate part. This is because the particular coin path 21 is not filled by the specific and the particular coins 61 and 62 even if the specific coin 61 is erroneously supplied to the particular coin path 21.

Figure 5:
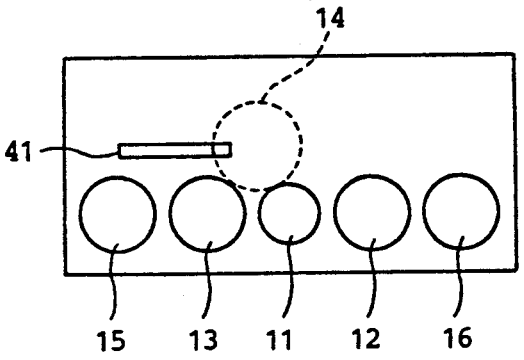
FIG. 5 is a plan view of a modification of the coin storage parts illustrated in FIG. 2.

As will be clearly understood from FIG. 5, it is preferable that the first coin storage tube 11 has an inner diameter which is slightly larger than the first predetermined diameter but smaller than an inner diameter of each of the second through the sixth coin storage tubes 12 to 16. With the arrangement, it is possible to make the coin separator in a small size.

Figure 6:
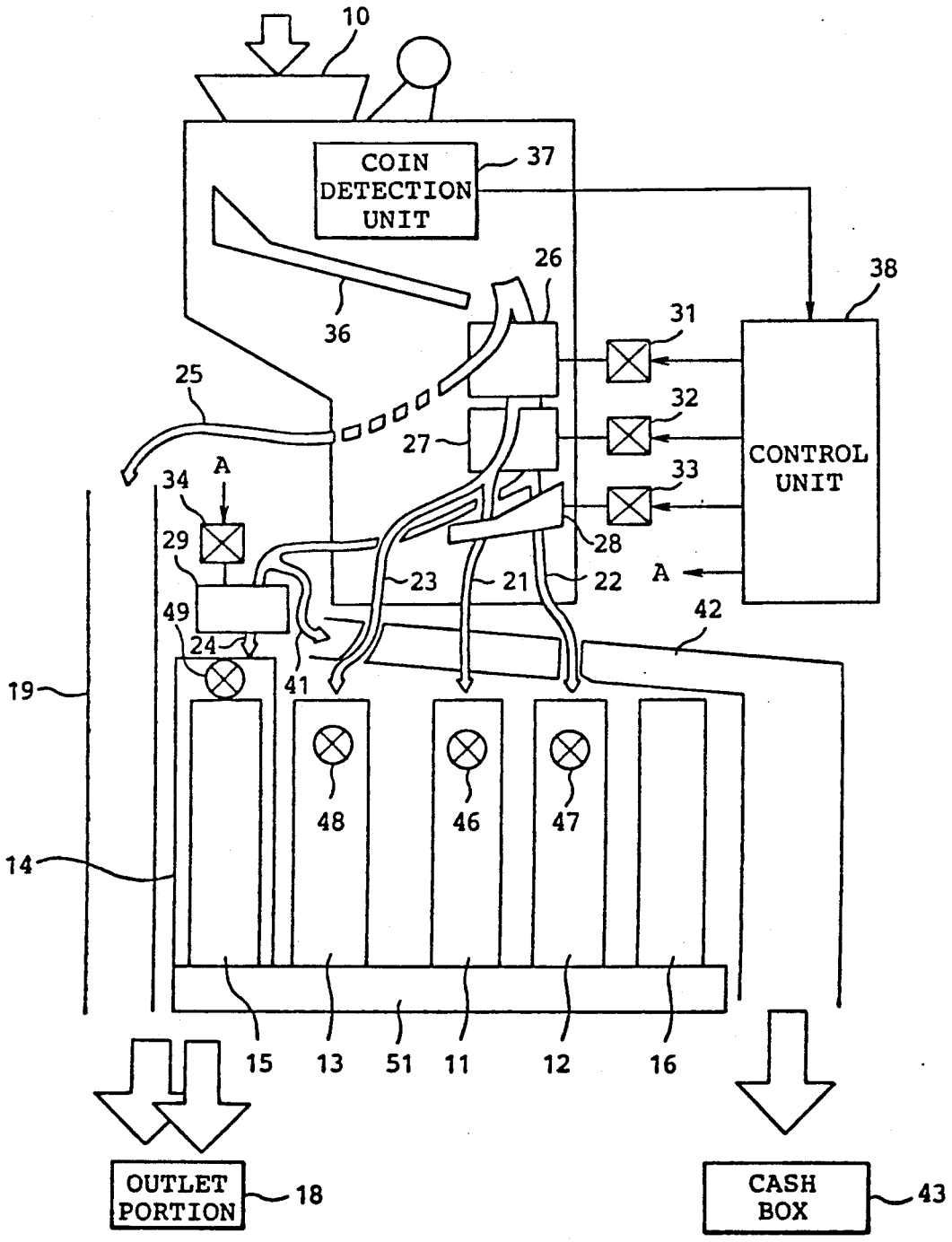
FIG. 6 is a schematic diagram of a coin separator according to a second embodiment of this invention.
Figure 7:
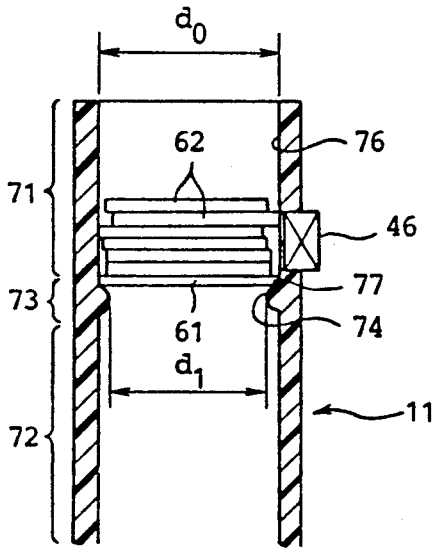
FIG. 7 is a sectional view of one of coin storage parts included in the device illustrated in FIG. 6.

Referring to FIGS. 6 and 7, description will be made as regards a coin separator according to a second embodiment of this invention. The coin separator comprises similar parts designated by like reference numerals.

The first coin storage tube 11 comprises inlet, storing, and intermediate portions 71, 72, and 73. The inlet portion 71 is a cylindrical portion with an inner diameter $d_0$ which is larger than the specific diameter of the specific coin 61. The first coin overflow sensor 46 is attached to the inlet portion 71.

The storing portion 72 is for storing the particular coin 62. Preferably, the storing portion 72 has an inner diameter which is equal to the inner diameter $d_0$ of the inlet portion 71.

The intermediate portion 73 is between the inlet and the storing portions 71 and 72 and comprises a ring-shaped projection 74 which is inwardly projected from an inner surface 76 of the inlet portion 71 and which defines a circular passing hole for permitting the particular coin 62 to pass therethrough. The projection 74 has an engaging surface 77 at a position which is slightly lower than the first coin overflow sensor 46. As will be clearly understood from the above, a diameter $d_1$ of the circular passing hole is smaller than the specific diameter of the specific coin 61 but larger than the particular diameter, namely, the first predetermined diameter of the particular coin 62.

A combination of the inlet and the intermediate portions 71 and 72 is referred to as a coupling section.

It will be assumed that the other coin 61 is supplied to the particular coin path 21. In this event, the specific coin 61 reaches to the inlet portion 71 of the first coin storage tube 11 after passing through the particular coin path 21. In the inlet portion 71, the specific coin 61 is engaged with the engaging surface 77 of the projection 74. Therefore, the specific coin 61 is stopped as the erroneous coin in the inlet portion 71 to close the circular passing hole. In this event, the projection 74 is referred to as a stopper arrangement.

Thereafter, the particular coin 62 will be supplied to the particular coin path 21. In response, the particular coin 62 comes in the inlet portion 71 and is superposed on the specific coin 61, namely, the erroneous coin. Similar operation will be repeated when each coin is supplied to the particular coin path 21. As a result, the specific and the particular coins 61 and 62 are stored in the inlet portion 71. This results in producing of the overflow signal as a detection signal from the first coin overflow sensor 46. In this event, the first coin overflow sensor 46 is referred to as a detecting arrangement.

Responsive to the overflow signal, the control unit 38 controls the driving part. More particularly, the first and the second gates 26 and 27 are opened with closing of the third and the fourth gates 28 and 29 even when the particular coin 62 is detected in the detecting arrangement. As a result, the particular coin 62 is sent to the cash box 43 through the branched and the additional coin paths 41 and 42.

With the arrangement, the trouble is not caused in the gate part. This is because the particular coin path 21 is not supplied with any coins after the first coin overflow sensor 46 detects the specific coin 61.

It is a matter of course that the particular coin 62 is passed through the circular passing hole in case where the specific coin 61 is not stopped in the inlet portion 71.

Figure 8:
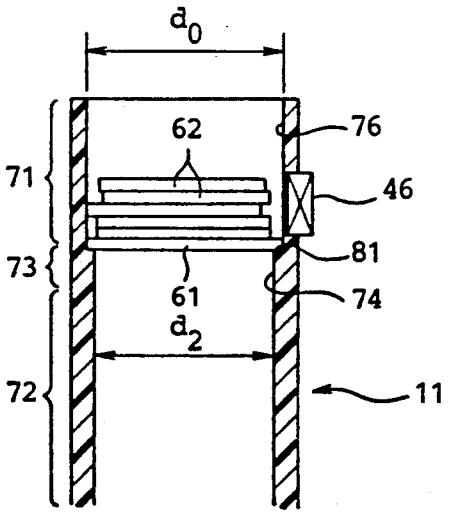
FIG. 8 is a sectional view of a modification of the coin storage part illustrated in FIG. 7.

Referring to FIG. 8, description will be made as regards a modification of the first coin storage tube 11. In the first coin storage tube 11, each of the storing and the intermediate portions 72 and 73 has an inner diameter $d_2$ which is smaller than the specific diameter of the specific coin 61 but larger than the particular diameter of the particular coin 62. Namely, the projection 74 is extended from the intermediate portion 73 to the storing portion 72. The inner diameter $d_2$ is substantially equal to the diameter $d_1$ of the circular passing hole of the first coin storage tube 11 shown in FIG. 7. As a result, the intermediate portion 73 has a radial surface 81 at an inner surface thereof. The radial surface 81 is radially inwardly extended from the inner surface 76 of the inlet portion 71 and serves as the engaging surface depicted at a numeral 77 in FIG. 7.

With the arrangement, it is readily possible to manufacture the first coin storage tube 11. This is because the radial surface 81 may be produced by working an inner surface of a pipe member which has a constant thickness.

While the present invention has thus far been described in connection with only preferred embodiments thereof, it will readily be possible for those skilled in the art to put this invention into practice in various other manners. For example, another coin sensor is provided to the first storing tube 11 in addition to the first coin overflow sensor 46 for detecting reception of the specific coin 61 in the inlet portion 71. Although the description is made as regards the trouble caused in connection with coins of the first and the second kinds, it is a matter of course that the present invention may be applied to resolve similar trouble in connection with coins of the second, the third, and the fourth kinds.

What is claimed is:

1. A coin separator comprising coin selecting means for selecting a particular coin from coins with reference to a kind of each coin, coin storage means for storing said particular coin, and a particular coin path coupled to said coin selecting means for delivering said particular coin to said coin storage means, said coin storage means having a coupling section coupled to said particular coin path, said coin selecting means erroneously selecting a specific one of the coins to supply said specific coin as the particular coin into said particular coin path, said specific coin being different in a coin diameter from said particular coin, wherein the improvement comprises:

detecting means mounted on said coupling section for detecting said specific coin delivered into said coin storage means from said particular coin path to produce a detection signal; and control means coupled to said detection means and responsive to said detection signal for controlling said selecting means to close said particular coin path;

wherein said particular coin has a particular diameter and said specific coin has a specific diameter larger than the particular diameter;

wherein said coupling section comprises a cylindrical portion with an inner diameter larger than the specific diameter and stopper means for stopping said specific coin from passing through said coupling section; and wherein said detecting means is for detecting stop of said specific coin.

2. A coin separator as claimed in claim 1, said cylindrical portion of the coupling means having an inner surface, wherein said stopper means is a projection inwardly projecting from said inner surface with a projecting size so that said projection permits said particular coin to pass through said coupling section but retains said specific coin in said coupling section.

3. A coin separator as claimed in claim 1, said coupling section having coin overflow sensing means at a predetermined level in said coin storage means for sensing store of a predetermined number of coins within said coin storage means to produce an overflow signal, wherein said stopper means is disposed adjacent but below said coin overflow sensing means, said coin overflow sensing means serving as said detecting means to produce the overflow signal as said detection signal.

4. A coin separator comprising:

a coin path;

coin sorting means for sorting deposited coins generally by size and directing coins of generally a first diameter to said coin path and coins of diameters generally different from the first diameter to at least one other coin path different from said coin path;

a coin storage tube for coins of the first diameter, said tube having an inlet portion to which coins in said coin path flow, a coin storage portion and an intermediate portion therebetween, said intermediate portion having a pass-through diameter which is smaller than that of said inlet portion, said intermediate portion pass-through diameter being just sufficient to permit the coins of the first diameter to pass therethrough to said coin storage portion;

detection means for sensing after a coin of a diameter larger than said intermediate portion pass-through diameter passes through said inlet portion and is stopped at said intermediate portion and for generating a detection signal in response thereto; and gate means, activated at least in part by said detection signal, for blocking the flow of further coins from said coin sorting means to said inlet portion.

5. The coin separator of claim 4 wherein passage of further coins through said intermediate portion into said storage portion is blocked by the coin of the larger diameter and thereby any of the further coins flowing into said inlet portion stack up on the larger diameter coin.

6. The coin separator of claim 4 wherein said intermediate portion includes a bulbous ring-shaped projection defining the pass-through diameter.

7. The coin separator of claim 6 wherein said projection projects inwardly from an inner surface of said inlet portion such that the coin of a larger diameter directly engages said projection.

8. The coin separator of claim 4 wherein said inlet portion defines a cylindrical coin path.

9. The coin separator of claim 4 wherein said inlet portion has an inner diameter the same as that of said storage portion.

10. The coin separator of claim 4 wherein said detection means generates the detection signal after at least one additional coin has passed into said inlet portion and stacked up on the larger diameter coin.

11. The coin separator of claim 4 wherein said gate means causes the further coins to flow to a cash box.

12. The coin separator of claim 4 wherein said storage portion has an inner diameter substantially equal to said intermediate portion pass-through diameter.

13. The coin separator of claim 12 wherein said coin tube is formed by working a pipe of constant thickness to thereby define said inlet portion.

14. The coin separator of claim 4 wherein said detection means is spaced a slight distance above said intermediate portion.

15. The coin separator of claim 4 wherein said detection means is disposed in a recessed wall opening of said storage tube.

16. The coin separator of claim 12 wherein said intermediate portion projects in ward in a stepped projection configuration such that the coin of a larger diameter directly engages said stepped projection.

17. The coin separator of claim 6 wherein said projection further defines the inner diameter of said storage portion and said intermediate portion.

18. The coin separator of claim 10 wherein said detection means does not require said coin storage tube to be full in order to generate the detection signal.

19. A coin separator comprising:

a coin path;

coin sorting means for sorting deposited coins generally by size and directing coins of generally a first diameter to said coin path and coins of diameters generally different from the first diameter to at least one other coin path different from said coin path;

a coin storage tube to which coins following said coin path flow; and erroneous coin sorting detection means for defining an opening in the axis of said coin path and having diameter dimensions such that a coin of the first diameter passes therethrough to said coin storage tube and a coin of a second diameter larger than the first diameter which has been erroneously sorted is blocked from passing therethrough to said coin storage tube;

wherein said coin path is generally vertically disposed such that coins following therealong generally freely drop to said opening.

20. The coin separator of claim 19 wherein the erroneous coin sorting detecting means comprises a plate with said opening passing therethrough.

21. The coin separator of claim 20 wherein said plate is inclined with respect to the axis of said coin path.

22. The coin separator of claim 21 further comprising a recessed portion positioned relative to said plate so as to facilitate turning of the coin of the second diameter, the sliding of that coin down said inclined plate and the discharging of that coin out a discharge coin path.

23. The coin separator of claim 19 further comprising recessed means for facilitating turning of the coins of the second diameter as they impact said defining means and discharging them away from said opening and said coin storage tube.

24. The coin separator of claim 23 wherein the erroneous coin sorting detecting means comprises an inclined plate and said recessed means is positioned at the top of said inclined plate.

25. The coin separator of claim 19 further comprising a coin discharge path through which coins of the second diameter contacting said erroneous coin sorting detection means flow.

26. The coin separator of claim 25 further comprising a cash box to which coins of the second diameter in said coin discharge path flow.

27. The coin separator of claim 19 wherein the different diameter coins are larger than the first diameter coins and wherein said coin path has a larger diameter than that of said other coin path.

28. The coin separator of claim 19 further comprising path means for defining another coin path different than and larger than said coin path and said other coin path for guiding coins larger than the first and the different diameter coins.

29. The coin separator of claim 19 wherein each of said coin paths is larger than said second diameter in cross-sectional size thereof.

30. A coin separator comprising:

a coin path;

coin sorting means for sorting deposited coins generally by size and directing coins of generally a first diameter to said coin path and coins of diameters generally different from the first diameter to at least one other coin path different from said coin path;

a coin storage tube to which coins following said coin path flow; and erroneous coin sorting detection means for defining an opening in said coin path and having diameter dimensions such that a coin of the first diameter passes therethrough to said coin storage tube and a coin of a second diameter larger than the first diameter which has been erroneously sorted is blocked from passing therethrough to said coin storage tube;

wherein said erroneous coin sorting detection means includes a plate member disposed at an angle to said coin path and said opening comprises a circular opening through said plate member.

31. The coin separator of claim 30 further comprising a recessed portion positioned relative to said plate so as to facilitate turning of the coin of the second diameter, the sliding of that coin down said inclined plate and the discharging of that coin out a discharge coin path.

32. The coin separator of claim 30 further comprising recessed means for facilitating turning of the coins of the second diameter as they impact said erroneous coin sorting detection means and discharging them away from said opening and said coin storage tube.

33. The coin separator of claim 32 wherein said recessed means is positioned at the top of said inclined plate member.

34. The coin separator of claim 30 further comprising a coin discharge path through which coins of the second diameter contacting said erroneous coin sorting detection means flow.

35. The coin separator of claim 34 further comprising a cash box to which coins of the second diameter in said coin discharge path flow.

36. The coin separator of claim 30 wherein the different diameter coins are larger than the first diameter coins and wherein said coin path has a larger diameter than that of said other coin path.

37. The coin separator of claim 30 further comprising path means for defining another coin path different than and larger than said coin path and said other coin for guiding coins larger than the first and the different diameter coins.

38. The coin separator of claim 30 wherein each of said coin paths is larger than said second diameter is cross-sectional size thereof.

39. A coin separator comprising:

a coin path;

coin sorting means for sorting deposited coins generally by size and directing coins of generally a first diameter to said coin path and coins of diameters generally different from the first diameter to at least one other coin path different from said coin path;

a coin storage tube to which coins following said coin path flow; and erroneous coin sorting detection means for defining an opening in said coin path and having diameter dimensions such that a coin of the first diameter passes therethrough to said coin storage tube and a coin of a second diameter larger than the first diameter is blocked from passing therethrough to said coin storage tube;

wherein said erroneous coin sorting means includes a plurality of coin directing gates; and wherein said erroneous coin sorting detection means is disposed after said coin sorting means relative to the flow of coins following said coin path such that said erroneous coin sorting detection means detects a coin of the second diameter erroneously sorted by said coin sorting means and prevents the erroneously sorted coin of the second diameter from passing to said coin storage tube.

40. The coin separator of claim 39 wherein said coin directing gates comprise electromagnetic solenoid driven gates.

41. The coin separator of claim 39 wherein said erroneous coin sorting detection means comprises a plate with said opening passing therethrough.

42. The coin separator of claim 41 wherein said plate is inclined with respect to the axis of said coin path.

43. The coin separator of claim 42 further comprising a recessed portion positioned relative to said plate so as to facilitate turning of the coin of the second diameter, the sliding of that coin down said inclined plate and the discharging of that coin out a discharge coin path.

44. The coin separator of claim 39 further comprising recessed means for facilitating turning of the coins of the second diameter as they impact said erroneous coin sorting detection means and discharging them away from said opening and said coin storage tube.

45. The coin separator of claim 44 wherein said erroneous coin sorting detection means comprises an inclined plate and said recessed means is positioned at the top of said inclined plate.

46. The coin separator of claim 39 further comprising a coin discharge path through which coins of the second diameter contacting said erroneous coin sorting detection means flow.

47. The coin separator of claim 46 further comprising a cash box to which coins of the second diameter in said coin discharge path flow.

48. The coin separator of claim 39 wherein the different diameter coins are larger than the first diameter coins and wherein said coin path has a larger diameter than that of said other coin path.

49. The coin separator of claim 39 further comprising path means for defining another coin path different than and larger than said coin path and said other coin for guiding coins larger than the first and the different diameter coins.

50. The coin separator of claim 39 wherein each of said coin paths is larger than said second diameter in cross-sectional size thereof.

51. A coin separator comprising:

a coin path;

coin sorting means for sorting deposited coins generally by size and directing coins of generally a first diameter to said coin path and coins of diameters generally different from the first diameter to at least one other coin path different from said coin path;

a coin storage tube to which coins following said coin path flow; and erroneous coin sorting detection means for defining an opening in said coin path and having diameter dimensions such that a coin of the first diameter passes therethrough to said coin storage tube and a coin of a second diameter larger than the first diameter is blocked from passing therethrough to said coin storage tube;

wherein said erroneous coin sorting means includes coin detecting means for detecting the size of the deposited coins and sending a coin path determining signal in response to the detected size; and wherein said coin sorting means is disposed after said coin sorting means relative to the flow of coins following said coin path such that said coin sorting check means detects a coin of the second diameter erroneously sorted by said coin sorting means and prevents the erroneously sorted coin of the second diameter from passing to said coin storage tube.

52. The coin separator of claim 51 wherein said erroneous coin sorting check means comprises a plate with said opening passing therethrough.

53. The coin separator of claim 51 wherein said plate is inclined with respect to the axis of said coin path.

54. The coin separator of claim 53 further comprising a recessed portion positioned relative to said plate so as to facilitate turning of the coin of the second diameter, the sliding of that coin down said inclined plate and the discharging of that coin out a discharge coin path.

55. The coin separator of claim 51 further comprising recessed means for facilitating turning of the coins of the second diameter as they impact said erroneous coin sorting check means and discharging them away from said opening and said coin storage tube.

56. The coin separator of claim 55 wherein said erroneous coin sorting check means comprises an inclined plate and said recessed means is positioned at the top of said inclined plate.

57. The coin separator of claim 51 further comprising a coin discharge path through which coins of the second diameter contacting said erroneous coin sorting check means flow.

58. The coin separator of claim 57 further comprising a cash box to which coins of the second diameter in said coin discharge path flow.

59. The coin separator of claim 51 wherein the different diameter coins are larger than the first diameter coins and wherein said coin path has a larger diameter than that of said other coin path.

60. The coin separator of claim 51 further comprising path means for defining another coin path different than and larger than said coin path and said other coin for guiding coins larger than the first and the different diameter coins.

61. The coin separator of claim 51 wherein said coin path determining signal controls the opening and closing of a plurality of coin directing gates.

62. The coin separator of claim 61 wherein said gates comprise electromagnetic solenoid driven gates.

63. The coin separator of claim 51 wherein each of said coin paths is larger than said second diameter in cross-sectional size thereof.

* * * * *